United States Patent [19]

Karakida et al.

[11] Patent Number: 4,873,165

[45] Date of Patent: Oct. 10, 1989

[54] ELECTROPHOTOGRAPHIC PHOTORECEPTOR HAVING OVERLAYER COMPRISING CARBON

[75] Inventors: Ken-ichi Karakida; Shigeru Yagi, both of Kanagawa, Japan

[73] Assignee: Fuji Xerox Co., Ltd., Tokyo, Japan

[21] Appl. No.: 144,006

[22] Filed: Jan. 15, 1988

[30] Foreign Application Priority Data

Jan. 16, 1987 [JP] Japan ..... 6047

[51] Int. Cl.[4] ..... G03G 5/082; G03G 5/14

[52] U.S. Cl. ..... 430/66; 430/132; 430/130; 430/67

[58] Field of Search ..... 430/66, 67, 130, 132

[56] References Cited

U.S. PATENT DOCUMENTS 4,687,722 8/1987 Ogawa ..... 430/67 X

*Primary Examiner*—J. David Welsh

*Attorney, Agent, or Firm*—Sughrue, Mion, Zinn, Macpeak and Seas

[57] ABSTRACT

An electrophotographic photoreceptor is disclosed, which comprises a support, a light-sensitive layer and a surface layer, the surface layer being predominantly composed of carbon and containing an element capable of forming a tetrahedral bond.

12 Claims, 1 Drawing Sheet

ELECTROPHOTOGRAPHIC PHOTORECEPTOR HAVING OVERLAYER COMPRISING CARBON

FIELD OF THE INVENTION

The present invention relates to an electrophotographic photoreceptor that has a surface layer with improved hardness and which will not produce a blurred image even if it is used repeatedly.

BACKGROUND OF THE INVENTION

The use of amorphous silicon in electrophotographic photoreceptors has been proposed in U.S. Pat. No. 4,265,991. In this approach, a silicon-based photoconductive layer is disposed on a support. Electrophotographic photoreceptors employing such a silicon-based photoconductive layer have distinct advantages in terms of mechanical strength, panchromaticity and sensitivity in the longer wavelength range as compared with conventional photoreceptors that employ inorganic photoconductive materials such as Se, tri-Se, ZnO and CdS, and organic photoconductive materials in photoconductive layers. However, these new photoreceptors have their own problems. Specifically, they produce a blurred image if they are left to stand in the atmosphere, especially in a hot and humid atmosphere. Moreover, when they are worn such as with the residual toner cleaning blade or paper stripping fingers in electrophotographic processes, their surface changes in such a way as to produce an image having "streak" defects. To eliminate these problems, a silicon-based light-sensitive layer provided with various surface layers having compositions such as Si/N, Si/O and Si/C that will not harm the hardness of the light-sensitive layer have been proposed in U.S. Pat. Nos, 4,394,426 and 4,394,425. These surface layers are effective in solving the aforementioned problems.

However, photoreceptors coated with such surface layers such as those with compositions of Si/N, Si/0, Si/C, etc., have a new problem in that upon repeated use in a hot and humid atmosphere for a prolonged period, they produced a blurred image and became no longer useful commercially.

SUMMARY OF THE INVENTION

The present invention solves the problem of conventional photoreceptors coated with surface layers having compositions such as Si/N, Si/0 and Si/C.

An object, therefore, of the present invention is to provide an electrophotographic photoreceptor that will not produce a blurred image under any operating conditions, even if it is repeatedly used in a hot and humid atmosphere for a prolonged period of time.

Another object of the present invention is to provide an electrophotographic photoreceptor having a satisfactory degree of surface hardness.

These objects of the present invention are attained by an electrophotographic photoreceptor which comprises a support, a light-sensitive layer and a surface layer, said surface layer being predominantly composed of carbon and containing an element capable of forming a tetrahedral bond.

DETAILED DESCRIPTION OF THE INVENTION

Under ordinary conditions, carbon atoms will readily change their coordination number between 2, 3 and 4. As a result, carbon-based films that are obtained by a plasma-assisted Chemical Vapor Deposition (CVD) method have a tendency to contain graphitic carbon and the carbon films that depend on diamond-like tetrahedrally coordinated carbon atoms for ensuring a satisfactory degrees of hardness and transparency can only be produced under very limited conditions (for example, elevated temperatures i.e., 500° to 900° C.) and, hence, are difficult to use as surface layers for electrophotographic photoreceptors.

The present inventors have found that by incorporating in a carbon-based film a small amount of atoms that have a coordination number of 4 and which are capable of producing tetrahedral bonds (preferably, with carbon atoms), the formation of tetrahedral bonds of carbon atoms can be accelerated to achieve a marked increase in the hardness of the film. The present inventors have also found that a surface layer that is predominantly composed of carbon and which contains an element capable of forming a tetrahedral bond (preferably, with carbon atoms) is highly effective in reducing the possibility of production of a blurred image on an electrophotographic photoreceptor, in particular, on a silicon-based light-sensitive layer, when it is repeatedly used in a hot and humid atmosphere, and that a photoreceptor having such a surface layer ensures the production of copied images of consistent quality under any environment encountered during the process. The electrophotographic photoreceptor of the present invention has been accomplished on the basis of these findings.

Figure 4:
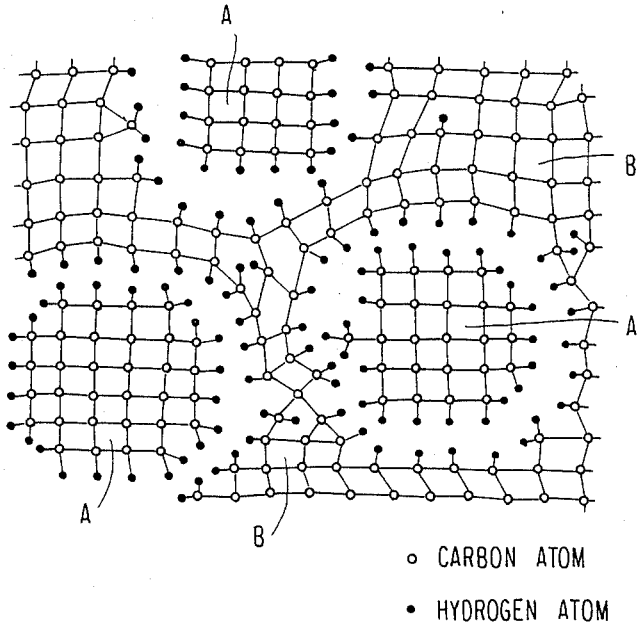
FIG. 4 is a sketch of a model of a crystalline carbon phase mixed with an amorphous phase.

The surface layer provided on the electrophotographic photoreceptor of the present invention is predominantly composed of carbon and contains an element capable of forming a tetrahedral bond (preferably, with carbon atoms). This surface layer may assume any state, crystalline, amorphous or a mixture of crystalline and amorphous phases. FIG. 4 depicts a model for a mixture of crystalline and amorphous phases. As shown in FIG. 4, the mixture of crystalline and amorphous phases comprises a crystalline carbon region A that is surrounded with hydrogen atoms, which surroundings of the region A are surrounded with an amorphous carbon region B.

The amount of the element that is capable of forming a tetrahedral bond and which is to be incorporated in the carbon-based surface layer may be variously determined but it is preferably determined to achieve a balance between the following three requirements: a broad range of spectral sensitivity is achieved by the light-sensitive layer disposed under the surface layer; a high degree of hardness is exhibited by the surface layer; and minimum image blur occurs even if the photoreceptor is repeatedly used in a hot and humid atmosphere. If an element capable of forming a tetrahedral bond is incorporated in a film that is predominantly composed of carbon, the surface layer of the film begins to become colored and as the addition of the element is increased, the surface hardness of the layer is increased but, at the same time, the absorption of visible light by the surface layer is also increased, narrowing the range of spectral sensitivity of the light-sensitive layer lying under the surface layer. In other words, the increased addition of the element capable of forming a tetrahedral bond contributes to the increase in surface hardness but, on the other hand, the chance of image blurring is increased and the range of spectral sensitivity is narrowed. In the opposite case (i.e., the addition of the element is decreased), favorable conditions are produced for the purpose of minimizing the chance of image blurring and extending the range of spectral sensitivity but, on the other hand, the resulting surface hardness is insufficient to attain the objects of the present invention. Therefore, in order to attain a satisfactory level of surface hardness and a wide range of spectral sensitivity while substantially eliminating the chance of a blurred image being produced, an optimum range for the content of the element capable of forming a tetrahedral bond to be incorporated in the surface layer is preferably determined in such a way that the number of atoms of said element (i.e., ratio) is about 0.5 or less, more preferably about 0.2 or less, and most preferably from about 0.01 to 0.1 per one atom of carbon atom.

The surface layer of the electrophotographic photoreceptor of the present invention can preferably contain hydrogen for the purpose of improving its electrical characteristics and enhancing its chemical stability. A suitable amount of hydrogen which can be present ranges from 4 to 70 atom %, preferably 10 to 40 atom %, per atom of carbon.

The electrophotographic photoreceptor of the present invention is hereinafter described in greater detail with reference to the accompanying drawings.

Figure 1:
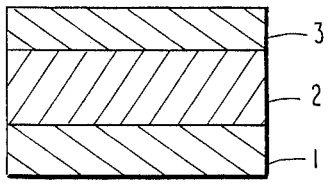
FIG. 1 is a schematic diagram showing the basic structure of the electrophotographic photoreceptor of the present invention.

The photoreceptor shown in FIG. 1 comprises a support 1, a light-sensitive layer 2 and a surface layer 3.

The support 1 may be electrically conductive or insulating. Useful conductive supports include metals such as aluminum and alloys such as stainless steel. Electrically insulating supports include films or sheets of synthetic resins such as polyesters, polyethylene, polycarbonates, polystyrene and polyamides, as well as glass, ceramics and paper. If an electrically insulating support is employed, it must be rendered electrically conductive on at least the surface which is in contact with other layers. This can be done by various treatment methods such as evaporating, sputtering or laminating a metal thereon to form a conductive support. The support may assume any desired shape such as that of a cylinder, belt or a plate. The support may be a multi-layered structure, if desired. The thickness of the support may be appropriately selected depending upon the type of photoreceptor required but it is typically set at about 10 μm or more.

The light-sensitive layer 2 preferably has such a composition that it contains silicon as the predominant component. A suitable light-sensitive layer that is predominantly composed of silicon can be formed on the support by a variety of techniques such as glow discharge decomposition, sputtering, ionic plating and vacuum evaporation. A suitable film-forming technique can be selected as appropriate, but a glow discharge decomposition of a silane (e.g., $SiH_4$) gas by plasma-assisted CVD method is preferred. This technique is capable of producing a light-sensitive layer that contains an adequate amount (i.e., 5 to 25 atom %) of hydrogen and which features a comparatively high dark resistivity while affording a high light sensitivity. These characteristics render the layer suitable for the use of photoreceptors in electrophotographic and other applications.

The formation of a silicon-based light-sensitive layer is hereinafter described assuming that it is formed by a plasma-assisted CVD method. The feed for producing a silicon-based light-sensitive layer is selected from silanes (e.g., silane and disilane) and silicon crystals. The feed gas can be mixed with a carrier gas selected from hydrogen, helium, argon, neon, etc. The ratio of the carrier gas in the mixture gas (flow rate of the carrier gas/flow rate of the silane gas, the carrier gas, etc.) is from 0 to 99 volume %. In order to control the dark resistivity of the light-sensitive layer or the polarity of charges to be deposited thereon, the feed gas may be further mixed with a dopant gas such as a diborane ($B_2H_6$) gas or a phosphine ($PH_3$) gas so that the photoconductive layer will be doped with an impurity element such as boron (B) or phosphorus (P). The light-sensitive layer may further contain additional atoms such as halogen, carbon, oxygen or nitrogen atoms with a view to increasing dark resistivity, light sensitivity or chargeability (i.e., the ability to collect charges or charge potential per unit thickness of the layer). It is also possible to incorporate germanium (Ge) or any other suitable element in the light-sensitive layer for the purpose of extending the sensitivity to the longer wavelength range of the spectrum. It is particularly preferred for the light-sensitive layer to be an i-type (intrinsic) semiconductor layer that is predominantly composed of silicon and which contains a small amount (i.e., 0.1 ppm to 100 ppm by volume) of an element of group IIIB of the periodic table (preferably boron). In order for the various elements mentioned above to be incorporated in the light-sensitive layer, use of a silane gas as the principal feed and gaseous forms of materials containing the necessary elements are charged into a plasma-assisted CVD apparatus and are subsequently decomposed by glow discharge.

The thickness of the light-sensitive layer, e.g., silicon-based, can vary but it is preferably within the range of 1 to 200 μm, more preferably in the range of 5 to 100 μm.

If desired, the electrophotographic photoreceptor of the present invention may have a structure where another layer is formed adjacent either the top or bottom or both the top and bottom of the silicon-based light-sensitive layer as described in U.S. Pat. Nos. 4,265,991, 4,394,426, 4,394,425 and 4,225,222. Examples of such additional layer are listed below: a charge injection blocking layer such as a p-type semiconductor layer formed by doping amorphous silicon with an element of group III of the periodic table, an n-type semiconductor layer formed by doping amorphous silicon with an element of group V, or an insulating layer; a sensitizing layer such as a layer formed by doping amorphous silicon with fine-crystalline germanium or tin; an adhesive layer such as a layer formed by doping amorphous silicon with nitrogen, carbon, oxygen, etc.; and a layer that is capable of controlling the electrical and image-related characteristics of the photoreceptor, such as a layer containing both elements of groups IIIB and V of the periodic table. The thickness of each of these optional layers may vary but the thickness is typically set within the range of 0.01 to 10 μm for each layer.

Figure 2:
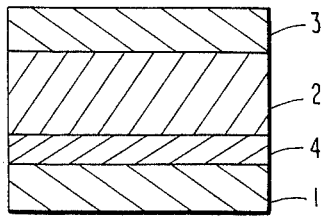
FIGS. 2 and 3 are schematic diagrams of modified versions of the electrophotographic photoreceptor shown in FIG. 1.
Figure 3:
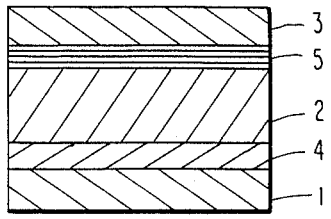

Two embodiments where the electrophotographic photoreceptor of the present invention has another layer formed adjacent to either the top or bottom or both the top and bottom of the light-sensitive layer are shown in FIGS. 2 and 3. In the embodiment shown in FIG. 2, a charge injection blocking layer 4 is disposed between the light-sensitive layer 2 and the support 1. In the embodiment shown in FIG. 3, a charge injection blocking layer 4 is disposed between the light-sensitive layer 2 and the support 1 and, at the same time, the layer 5 that contains an element of group IIIB of the periodic table and/or an element of group VB, or the layer 5 in which the components of the surface layer 3 intermingle with those of the light-sensitive layer 2 to provide a composition that is intermediate between the compositions of the two layers is disposed between the layers 2 and 3.

The above-described light-sensitive layer and optional layers may be formed by the plasma-assisted CVD method. A light-sensitive layer containing one or more of the impurity elements listed above is formed by performing glow discharge decomposition of a silane gas that is introduced into a plasma-assisted CVD apparatus together with the gaseous forms of materials containing such impurity elements. In this method, silane ($SiH_4$) gas is decomposed by the glow discharge. In forming a layer adjacent to either the top or bottom or both the top and bottom of the silicon-based light-sensitive layer, either DC discharge or AC discharge may be employed as an effective film forming technique. Typical operating conditions employed in DC or AC discharge are specified below: frequency, from 0 to 3 GHz and preferably from 0.5 to 3 GHz; pressure for discharging, from $1\times10^{-5}$ to 10 Torr (0.001 to 1330 Pa) and preferably from $1\times10^{-4}$ to 5 Torr (0.01 to 665 Pa); and support temperature, from 100° to 400° C. and preferably from 150° to 300° C.

The surface layer 3 which is the most characteristic part of the present invention is hereinafter described in detail. This surface layer 3 is characterized both by being predominantly composed of carbon and by containing an element that is capable of forming a tetrahedral bond. This layer can be formed by any suitable methods such as glow discharge decomposition, sputtering, ionic plating or vacuum evaporation. The objects of the present invention are most effectively attained if the surface layer that is predominantly composed of carbon and which contains an element such as silicon capable of forming a tetrahedral bond is formed by decomposition using a plasma-assisted CVD method of a gas or gaseous form of a hydrocarbon compound and the gas or gaseous form of a material containing the element.

The following materials may be used as feeds for forming the surface layer of the photoreceptor of the present invention. Feeds for incorporating carbon as the predominant component include: aliphatic hydrocarbons such as paraffinic hydrocarbons represented by the formula $C_nH_{2n+2}$ (where n ranges from 1 to 10, and preferably from 1 to 4, such as methane, ethane, propane, butane and pentane) and olefinic hydrocarbons represented by the formula $C_nH_{2n}$ (e.g., where n ranges from 2 to 10, and preferably from 2 to 3, such as ethylene, propylene, butylene and pentene) and acetylenic hydrocarbons represented by the formula $C_nH_{2n-2}$ (e.g., where n ranges from 2 to 10 and preferably is 2, such as acetylene, allylene and butyne); alicyclic hydrocarbons (having from 3 to 8 carbon atoms and preferably from 3 to 6 carbon atoms such as cyclopropane, cyclobutane, cyclopentane, cyclohexane, cycloheptane, cyclobutene, cyclopentene and cyclohexene); aromatic compounds (having from 6 to 14 carbon atoms such as benzene, toluene, xylene, naphthalene and anthracene and preferably benzene, toluene, xylene and naphthalene); and organic substituted compounds thereof. These feed compounds may have a branched structure. Alternatively, they may be substituted with halogens such as hydrocarbon halides illustrated by, for example, carbon tetrachloride, chloroform, carbon tetrafluoride, trifluoromethane, chlorotrifluoromethane, dichlorodifluoromethane, bromotrifluoromethane, perfluoroethane and perfluoropropane.

Silicon is an example of the element that is capable of forming a tetrahedral bond. Useful silicon-containing feeds include silicon hydrides such as silane, disilane and trisilane, silicon halides such as silicon tetrachloride, trichlorosilane, dichlorosilane and silicon tetrafluoride, and organic silicon compounds such as tetramethylsilane and tetraethylsilane.

Each of the above-listed feed materials for introducing carbon as the predominant component of the surface layer and the silicon feed materials also listed above may be gaseous, solid or liquid at ordinary temperatures. If they are solid or liquid at ordinary temperatures, they are used after being vaporized. In forming the surface layer, one or more of the gaseous feeds selected from the feeds listed above are charged into a vacuum chamber, in which glow discharge is initiated to form the desired surface layer of amorphous carbon that contains both carbon and hydrogen as the principal components. In forming the surface layer, the above-listed gaseous feeds may be used together with a third gaseous material as required. Examples of such third gaseous materials are carrier gases selected from hydrogen, helium, argon, neon, etc. To improve the resistance and other characteristics of the surface layer, a gaseous or gasifiable material containing an element of group III of the periodic table (e.g., a boron compound such as diborane, boron trifluoride or boron trichloride) or an element of group V (e.g., a phosphorous compound such as phosphine, diphosphine, phosphorous pentafluoride, phosphorous trichloride or phosphorous pentachloride) or other elements may be employed so as to incorporate boron, phosphorous or other impurity elements in the surface layer. The surface layer may be photoconductive.

In the plasma-assisted CVD method, the feeds may be decomposed by either DC or AC glow discharge. Typical conditions to be employed for film formation are as follows: frequency, from 0 to 3 GHz and preferably from 0.5 to 3 GHz; pressure for discharging; from $1\times10^{-5}$ to 10 Torr (from 0.001 to 1330 Pa) and preferably from $1\times10^{-4}$ to 5 Torr (from 0.01 to 665 Pa); and support temperature, from 100° to 400° C. and preferably from 150° to 300° C. The thickness of the surface layer may vary but typically is within the range of from 0.01 to 10 μm, preferably from 0.05 to 5 μm, and particularly preferably from 0.1 to 3 μm.

While the foregoing discussion is primarily directed to the use of a silicon-based light-sensitive layer, it should be noted that the surface layer of the present invention which is predominantly composed of carbon and which contains an element capable of forming a tetrahedral bond may be provided on other inorganic photoconductive layers such as evaporated Se, Tri-Se or resin-bound CdS or ZnO photoconductive layers, or organic photoreceptors such as a multi-layered photoreceptor comprising a charge generation layer having a charge generating material dispersed in a binder resin and a charge transport layer having a charge transport material dispersed in a binder resin. In these cases, too, a surface layer having a satisfactory degree of hardness can be provided.

The following examples are given for the purpose of further illustrating the present invention but are in no way to be taken as limiting the present invention. Unless otherwise indicated herein, all parts percents, ratios and the like are by weight.

EXAMPLE 1

Using a capacitively coupled plasma-assisted CVD apparatus capable of forming an amorphous silicon film on a cylindrical substrate, a mixture of a silane ($SiH_4$) gas and a diborane ($B_2H_6$) gas was subjected to glow discharge decomposition so as to form a p-type amorphous silicon layer having a thickness of 0.2 μm and having a ratio of a flow rate by volume of $B_2H_6$ gas to the flow rate by volume of $SiO_4$ gas of 500 ppm on a cylindrical aluminum support, followed by the formation of an i-type (intrinsic) amorphous silicon layer having a thickness of 20 μm and having a ratio of flow rate by volume of $B_2H_6$ gas to a flow rate by volume of $SiO_4$ gas of 500 ppm. Thereon following the formation of this light-sensitive layer, the apparatus was evacuated and charged with ethylene ($C_2H_4$) gas and a silane ($SiH_4$) gas at rates of 100 ml/min and 5 ml/min, respectively. Glow discharge was initiated in the reactor, with its internal pressure being maintained at 1.0 Torr, so as to form a 0.5 μm thick surface layer that was predominantly composed of amorphous carbon and which contained silicon.

Analysis with an X-ray photoelectric spectrophotometer showed that this surface layer had the composition $C_7Si_1$. This surface layer was very hard (Vickers hardness (which was measured according to JIS Z-2244): 1,200 kg/cm$^2$).

The fabricated electrophotographic photoreceptor was set on a copying machine, corona-charged with a positive voltage and subjected to testing for producing $5\times10^4$ prints. Thereafter, image quality evaluation was conducted both in a hot and humid atmosphere (35° C.×85% R.H.) and in a cold and dry atmosphere (5° C.×15% R.H.) None of the images produced were blurred or had low density. They were also entirely free from scratches that might have been caused by abrasion with the cleaning blade made of rubber or paper stripping fingers made of iron.

EXAMPLE 2

A light-sensitive layer was formed on a cylindrical aluminum support using the same method and under the same conditions as in Example 1. Subsequently, the apparatus was evacuated and supplied with methane ($CH_4$) gas and a silane ($SiH_4$) gas at rates of 100 and 3 ml/min, respectively. Glow discharge was initiated in the reactor, with the internal pressure maintained at 1.0 Torr, so as to form a 0.5 μm thick surface layer that was predominantly composed of amorphous carbon and which contained silicon.

Analysis with an X-ray photoelectric spectrophotometer showed that this surface layer had the composition $C_5Si_1$. This surface layer was very hard (Vickers hardness (JIS Z-2244): 1,500 kg/cm$^2$).

With the thus produced electrophotographic photoreceptor, image quality evaluation was conducted using the same method and under the same conditions as in Example 1.Even after 5×104 cycles of copying, neither image blurring nor a decrease in image density occurred. The images obtained were entirely free from scratches that might have been caused by abrasion with the cleaning blade made of rubber or paper stripping fingers made of iron.

EXAMPLE 3

A light-sensitive layer was formed on a cylindrical aluminum support using the same method and under the same conditions as in Example 1. Subsequently, the apparatus was evacuated and supplied with methane ($CH_4$) gas and a silane ($SiH_4$) gas at the respective rates of 200 ml/min and 2 ml/min. Glow discharge was initiated in the reactor, with its internal pressure maintained at 1.0 Torr, so as to form a 0.5 μm thick surface layer that was predominantly composed of amorphous carbon and which contained silicon.

Analysis with an X-ray photoelectric spectrophotometer showed that this surface layer had the composition $C_8Si_1$. This surface layer was very hard (Vickers hardness (JIS Z-2244): 1,400 kg/cm$^2$).

With the thus produced electrophotographic photoreceptor, image quality evaluation was conducted using the same method and under the same conditions as in Example 1. Even after $5\times10^4$ cycles of copying, neither image blurring nor a decrease in image density occurred. The images obtained were entirely free from scratches that might have been caused by abrasion with the cleaning blade made of rubber or paper stripping fingers made of iron.

EXAMPLE 4

A light-sensitive layer was formed on a cylindrical aluminum support using the same method and under the same conditions as in Example 1. Subsequently, the apparatus was evacuated and supplied with ethane ($C_2H_6$) gas and silane ($SiH_4$) gas at the respective rates of 100 ml/min and 5 ml/min. Glow discharge was initiated in the reactor, with its internal pressure maintained at 1.0 Torr, so as to form a 0.5 μm surface layer that was predominantly composed of amorphous carbon and which contained silicon.

Analysis with an X-ray photoelectric spectrophotometer showed that this surface layer had the composition $C_{10}Si_1$. This surface layer was very hard (Vickers hardness (JIS Z-2244): 1,000 kg/cm$^2$).

With the thus produced electrophotographic photoreceptor, image quality evaluation was conducted using the same method and under the same conditions as in Example 1. Even after $5\times10^4$ cycles of copying neither image blurring nor a decrease in image density occurred. The images obtained were entirely free from scratches that might have been caused by abrasion with the cleaning blade made of rubber or paper stripping fingers made of iron.

As is apparent from the foregoing explanation and the data shown in Examples I to 4, the electrophotographic photoreceptor of the present invention comprises a surface layer that is predominantly composed of hydrogen- and carbon-based amorphous carbon. Being composed of these components, the surface layer has a very high degree of hardness and serves to protect satisfactorily the photoreceptor of the present invention against scratches that might be caused by abrasion with the cleaning blade, paper stripping fingers, etc, during electrophotographic processing. The photoreceptor of the present invention has the additional advantage that it does not produce a blurred image under any of the operating conditions encountered during use. A particularly high commercial value is provided since the photoreceptor can be repeatedly used in a hot and humid atmosphere for a prolonged period of time without producing a blurred or low-density image.

While the invention has been described in detail and with reference to specific embodiments thereof, it will be apparent to one skilled in the art that various . changes and modifications can be made therein without departing from the spirit and scope thereof.

What is claimed is:

1. An electrophotographic photorecorder which comprises (1) a support;

(2) a light-sensitive layer comprising an i-type semiconductor layer that is predominantly composed of amorphous silicon and contains a small amount of an element of group IIIB of the periodic table; and (3) a surface layer having a thickness of from 0.01 to 10 μm provided on the i-type semiconductor layer, said surface layer being predominantly composed of carbon and containing an element capable of forming a tetrahedral bond.

2. An electrophotographic photoreceptor as in claim 1, wherein said element capable of forming a tetrahedral bond is silicon.

3. An electrophotographic photoreceptor as in claim 1, wherein said surface layer is formed by a plasma-assisted CVD method.

4. An electrophotographic photoreceptor as in claim 1, wherein said surface layer contains hydrogen.

5. An electrophotographic photoreceptor as in claim 1, wherein the number of atoms of the element capable of forming a tetrahedral bond incorporated into the surface layer is 0.5 or less per one atom of carbon atom.

6. An electrophotographic photoreceptor as in claim 1, wherein a thickness of the light-sensitive layer is from to 200 μm.

7. An electrophotographic photoreceptor as in claim 1, wherein the light-sensitive layer is formed by a plasma-assisted CVD method.

8. An electrophotographic photoreceptor as in claim 1, wherein said surface layer contains boron in an amount of from 0.1 to 100 ppm by volume.

9. An electrophotographic photoreceptor as in claim 1, wherein the number of atoms of said element capable of forming a tetrahedral bond incorporated into said surface layer is from about 0.01 to 0.1 per one atom of carbon atom.

10. An electrophotographic photoreceptor as in claim 1, wherein said surface layer is formed by decomposition using a plasma-assisted CVD method of a gas or gaseous form of a hydrocarbon compound and a gas or gaseous form of a material containing said element capable of forming a tetrahedral bond.

11. An electrophotographic photoreceptor as in claim 10, wherein said hydrocarbon compound is selected from the group consisting of paraffinic hydrocarbons represented by formula $C_nH_{2n+2}$, where n is 1 to 10; olefinic hydrocarbons represented by formula $C_nH_{2n}$, where n is 2 to 10; acetylenic hydrocarbons represented by $C_nH_{2n-2}$, where n is 2 to 10; alicyclic hydrocarbons; aromatic compounds; and organic substituted compounds thereof.

12. An electrophotographic photoreceptor as in claim 10, wherein said gas or gaseous form of a material containing an element capable of forming a tetrahedral bond is selected from the group consisting of silicon hydrides, silicon halide and organic silicon compounds.

* * * * *